US009173046B2

(12) United States Patent
Frey et al.

(10) Patent No.: US 9,173,046 B2
(45) Date of Patent: Oct. 27, 2015

(54) MICROPHONE AND METHOD FOR MODELLING MICROPHONE CHARACTERISTICS

(75) Inventors: Tom-Fabian Frey, Braunschweig (DE); Daniel Schlessinger, Berkeley, CA (US); Stephan Scherthan, Lindwedel (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 669 days.

(21) Appl. No.: 13/410,531

(22) Filed: Mar. 2, 2012

(65) Prior Publication Data

US 2013/0230181 A1 Sep. 5, 2013

(51) Int. Cl.
*H04R 29/00* (2006.01)
*H04R 25/00* (2006.01)

(52) U.S. Cl.
CPC ..... *H04R 29/004* (2013.01); *H04R 25/407* (2013.01); *H04R 2201/401* (2013.01); *H04R 2201/403* (2013.01)

(58) Field of Classification Search
CPC ..... H04R 29/004; H04R 2201/401; H04R 2201/403; H04R 3/005; H04R 1/406
USPC ..... 381/92, 66, 58
See application file for complete search history.

(56) References Cited

U.S. PATENT DOCUMENTS 6,041,127 A * 3/2000 Elko ..... 381/92
8,284,952 B2 * 10/2012 Reining et al. ..... 381/92
8,433,075 B2 * 4/2013 Elko et al. ..... 381/92
2004/0165735 A1 * 8/2004 Opitz ..... 381/92
2009/0175466 A1 * 7/2009 Elko et al. ..... 381/94.2
2010/0061568 A1 * 3/2010 Rasmussen ..... 381/94.1
2012/0188434 A1 * 7/2012 Scopece et al. ..... 348/333.02

FOREIGN PATENT DOCUMENTS

WO WO 2011/042823 4/2011

OTHER PUBLICATIONS

Farina et al; "Measuring spatial impulse responses in concert halls and opera houses employing a spherical microphone array"; Sep. 2, 2007; ICA Madrid 2007.*

Williamsen; "Design and measurement of a dipole microphone" , May 14, 2009.*

Submission filed on Dec. 28, 2014 with the GPTO regarding the corresponding German patent application 10 2013 203 596.9.

Nils Peters et al., "Beamforming using a Spherical Microphone Array based on Legacy Microphone Characteristics", Proc. of International Conference on Spatial Audio, Oct. 2011.

(Continued)

*Primary Examiner* — Vivian Chin
*Assistant Examiner* — David Ton
(74) *Attorney, Agent, or Firm* — Frommer Lawrence & Haug LLP

(57) ABSTRACT

A method of modelling microphone characteristics of a target microphone is provided. An impulse response of target microphones is measured over different angles. A signal conditioning on the measurement data is performed. The spatial response based on a spatial response matching algorithm is matched and filter parameters and/or model parameters are determined.

4 Claims, 5 Drawing Sheets

(56) References Cited

OTHER PUBLICATIONS

Angelo Farina et al., "A spherical Microphone Array for Synthesizing Virtual Directive Microphones in Live Broadcasting and in Post Production", AES 40th International Conference, Tokyo, Japan, Oct. 2010.

PolarFlex (™)—System for Modeling and Microphone, http://www.imaico.co.jp/schps/polarflex.htm, Jul. 2007.

* cited by examiner

MICROPHONE AND METHOD FOR MODELLING MICROPHONE CHARACTERISTICS

BACKGROUND OF THE INVENTION

1. Field of the Invention

The present invention relates to a microphone as well as to a method for modelling microphone characteristics.

2. Description of Related Art

Microphones are known which allow a manipulation of their output signals based on filters in the microphone.

SUMMARY OF THE INVENTION

It is desirable to change the characteristics of a microphone to be able to adapt the microphone to different characteristics such that it is able to imitate or model other microphones.

It is therefore an object of the invention to provide a microphone which can imitate or model other microphones as well as a method for modelling a microphone.

Therefore, a method of modelling microphone characteristics of a target microphone is provided. An impulse response of target microphones is measured over different angles. A signal conditioning on the measurement data is performed. The spatial response based on a spatial response matching algorithm is matched and filter parameters and/or model parameters are determined.

According to an aspect of the invention, the signal conditioning comprises at least one of a time alignment, a truncation of the measurement data, a sinusoidal eccentricity removal, a smoothing and a symmetrising.

According to a further aspect of the invention, the spatial response matching algorithm is one of a constraint least square algorithm, a least square DB algorithm, a first order projection algorithm, a directivity index matching algorithm and a defuse field matching algorithm.

According to a further aspect of the invention, the model parameters are linear or non-linear model parameters.

Therefore, a microphone comprising at least a first and second microphone capsule, at least a first and second filter and a model unit for performing a processing based on the model is provided. The filter parameter of the first and second filter and the parameters of the model of the model unit are determined based on spatial measurements of a target microphone which is to be modelled or imitated such that the microphone performs as the target microphone.

The (non-linearity) parameters are determined by measurements, by physical models and/or by tuning by ear.

Further aspects of the invention are defined in the dependent claims.

WITH REFERENCE TO THE FIGURES BRIEF DESCRIPTION OF THE DRAWINGS

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

The microphones or microphone capsules according to the first embodiment detect audio signals and these detected audio signals undergo audio processing based on a number of parameters and/or characteristics to obtain a desired output audio signal. The desired parameters and characteristics will be determined beforehand and can be stored e.g. in the microphone or somewhere else.

Figure 1:
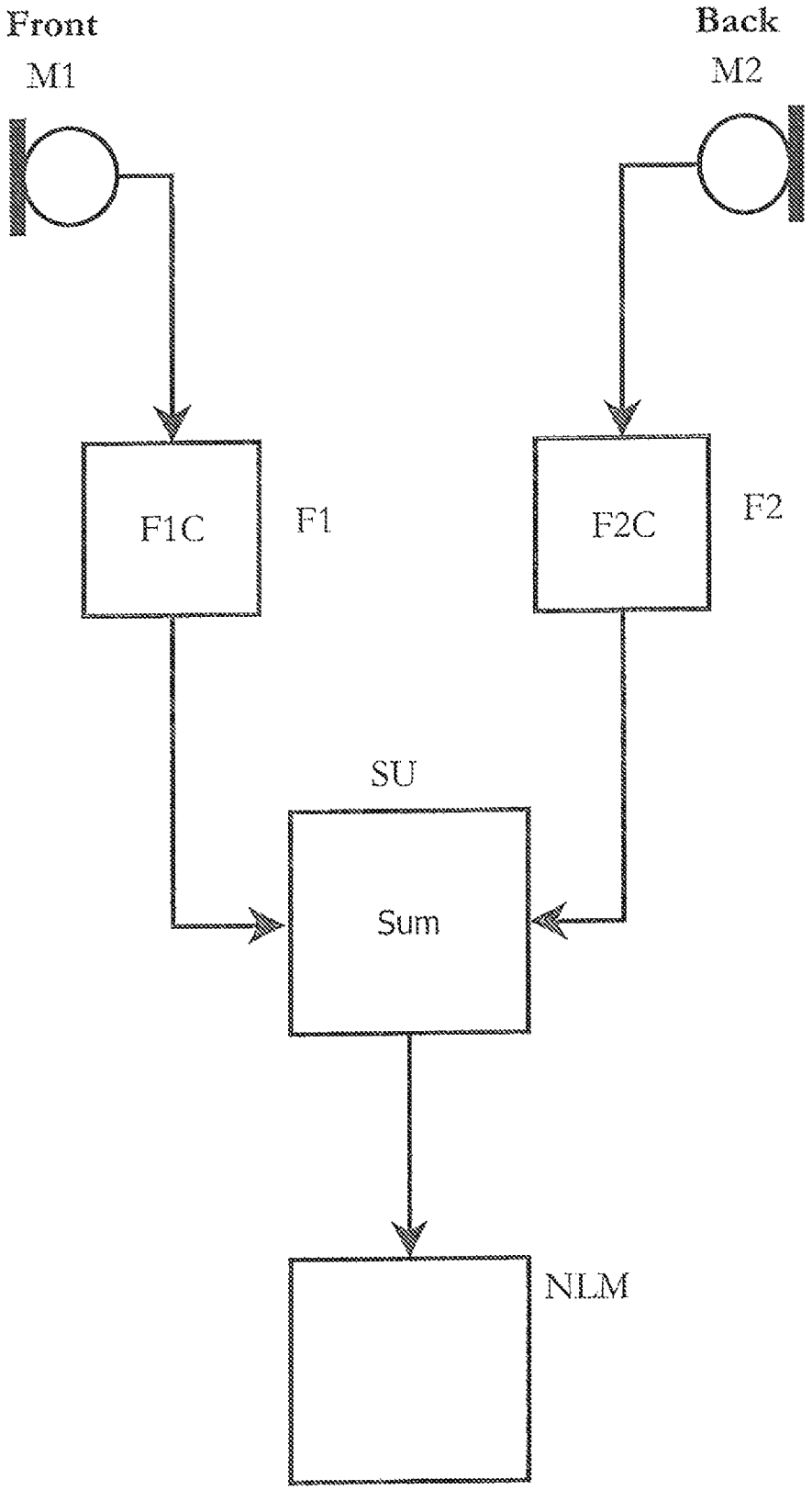
FIG. 1 shows a schematic diagram of a microphone according to a first embodiment.

FIG. 1 shows a block diagram of a microphone according to a first embodiment. The microphone comprises at least a first and second microphone capsule M1 (front), M2 (back). The first microphone capsule M1 is coupled to a first filter F1 and the second microphone capsule M2 is coupled to a second filter F2. The first and second filter F1, F2 are coupled to a summation unit SU, where the outputs of the first and second filter F1, F2 are summed. The result of this summation is forwarded to a non-linearity model unit NLM where the signal from the summation unit SU is undergoing a processing based on a non-linearity model. The model unit LNM can also be implemented as a linear model unit with a processing based on a linear model.

Filter characteristics F1C, F2C of the first and second filter (F1, F2) as well as the characteristics of the (non-linearity) model unit NLM are determined during a modelling processing of a microphone which is to be imitated.

The first and second filter F1, F2 can be FIR or IIR filter as well as suitable combination of both. A subsequent signal processing can be implemented as simple as possible on a host.

The non-linearity model of the non-linearity model unit is used to imitate a non-linear behaviour of a target microphone.

The non-linear behaviour is frequency dependent as distortions in low frequency signals can be identified easier than distortions in high frequency signals.

Alternatively to what is shown in FIG. 1, the non-linearity model unit NLM can also be arranged before or directly after the first and second filter unit F1, F2.

Figure 2:
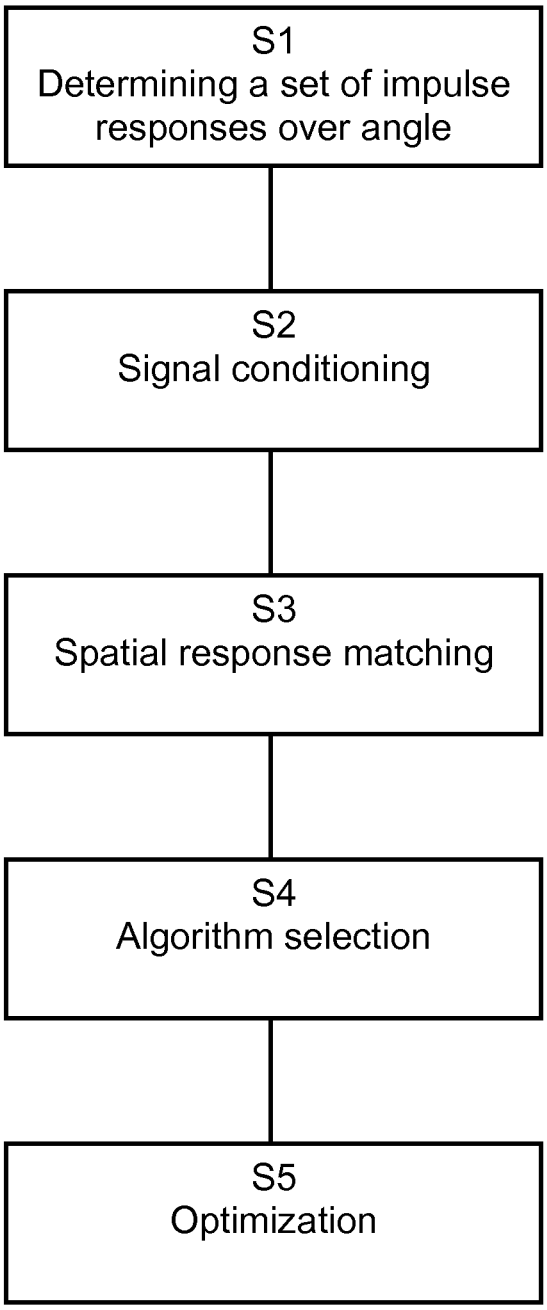
FIG. 2 shows a flow chart of a method of modelling a microphone according to a second embodiment.

FIG. 2 shows a flow chart of a method of modelling a microphone according to a second embodiment. In the second embodiment, the modelling of a specific microphone will be described in more detail. The obtained characteristics and parameters can for example be stored in the microphone according to the first embodiment. The flow starts with S1 where a set of accurate impulse response is determined over angle. Then the flow continues to step S2 where a signal conditioning of the measured data is performed. Thereafter, the flow continues to step S3 where a spatial response matching is performed using different algorithms. Then in step S4, a selection and filtering algorithm is performed and finally in step S5, an optimization step is performed.

According to the second embodiment, a spatial modelling of a microphone is performed. The spatial modelling is advantageous as the diffused sound (i.e., sound from random incident angles) is weighted as it would have been done in a microphone which is to be modelled or imitated.

With the method for modelling a target microphone, it is desirable to match the frequency dependent polar pattern of a target microphone for example with a microphone and a method of modelling a microphone according to a first embodiment.

In step S1, the accurate impulse response is detected over angle measurements. In particular, the acoustical measurements are taken by the first and second microphone capsule. The measurements can be in form of impulse responses, for example a recording impulse, sine sweeps, mls signals or etc. The impulse responses of all front end signals are taken simultaneously in order to be able to detect time delays between the signals. The impulse responses are taken over angles over 360°. The measurements can for example be taken by 5° increments.

In addition, to be able to more closely detect the three dimensional polar patterns, rings of measurements at more than one angle (horizontal, vertical) can be taken. The measurements can be taken at many different azimuth and elevation angles.

In addition, a reference measurement can be taken. This reference measurement can be deconvolved out of the signal to ensure that the measurements originate from the microphone and not any other sound sources. Furthermore, the use of sine sweeps is advantageous to avoid weak non-linearities in the entire system.

In step S2, the signal conditioning of the measurement data is performed. The signal conditioning can be performed by a great number of techniques or methods. These methods may include a time alignment. Here, the target and one of the source signals, for example the front capsule, are time aligned. A further signal conditioning technique is truncation. Here, the truncation of the measurement is used to reduce obvious late reflections. Alternatively or additionally, windowing may also be implemented.

A further signal conditioning technique is the sinusoidal eccentricity removal. This is necessary as the signal conditioning algorithms are sensitive to phase information. Typically, measurements are taken using a turnable or motorized turning mechanism. It can occur that the centre of the microphone capsule does not correspond exactly to the centre of the rotation. In this case, the time delays over angle must be compensated. This compensation is achieved by extracting the fundamental sinusoid from the time-delay-over-angle signal.

A further signal conditioning technique is the smoothing technique. By implementing the smoothing of critical bands of the frequency domains, noise in the measurement can be averaged out. Furthermore, some of the reflections can be reduced which are inherent in the measurements.

A further signal conditioning technique is symmetrising. The symmetrising is performed by averaging the two halves of the polar pattern over each frequency. Optionally, this step can be performed after the removal of the eccentricity. Preferably, a single spatial function over angle is provided for each frequency.

In step S3, a spatial response matching is performed using different algorithms. In order to match the spatial pattern over frequency, one of several algorithms described hereinafter can be used. The matching can be performed in the frequency domain using FFT for each location and running the matching over angle bin by bin to minimize the difference between the model and the target.

The matching can be performed by one of the following arguments: constrained least squares, least squares DB match, first order projection, directivity index matching, diffuse field matching and hybrids of these algorithms.

For the constrained least squares LSC algorithms, a least square matching formula is used while an on-axis value is weighted by a value which is few orders of magnitude greater than the rest. In addition, the use of different weighting functions is advantageous to take into account the projection from one-dimensional spatial functions into a two-dimensional spherical shell.

For least squares DB matching algorithms DBLS, a non-linear optimization Method is used to minimize the RMS of the difference in decibels between a model and the target over the angle. One way to achieve this minimizing of the RMS is the use of divide-and-conquer gradient descent methor or a Gauss-Newton algorithm. In addition, the use of the different weighting functions can be advantageous to take into account the projection from a one-dimensional spatial function into a two-dimensional spherical shell. Preferably, this technique is used with two front-end capsules in the microphone.

For first-order projection, the spatial responses are considered as being of a first order (a+b cos(phi)) (i.e., an omni component and a figure of eight component is present). Accordingly, the output signal is divided into a pure non-directive pressure part and a pressure gradient sensibility which is directive and has a figure-eight pattern.

Furthermore, for each frequency, a least squares fit in view of both sources and target signals is done onto a first order projection. Therefore, two coefficients are present for the sources and the targets if a two-capsule front end is used. Thereafter, the filter coefficients must be solved to determine the two coefficients.

In the directivity index matching, the best directivity index match is searched for. Similar to the least square DB match, a gradient descent or Gauss-Newton algorithm is used for minimizing the difference between the model and target directivity index for each frequency.

The diffuse field matching substantially corresponds to the directivity index matching wherein a diffuse field response is used for each frequency.

Furthermore, the above described algorithms can be combined. A concatenation of the frequency domain filters can be made by using LSC filter responses in the low frequency and the DBLS response in the high frequency.

Preferably, the spatial response matching is performed by the constrained least squares methods or the least squares DB method.

Figure 3:
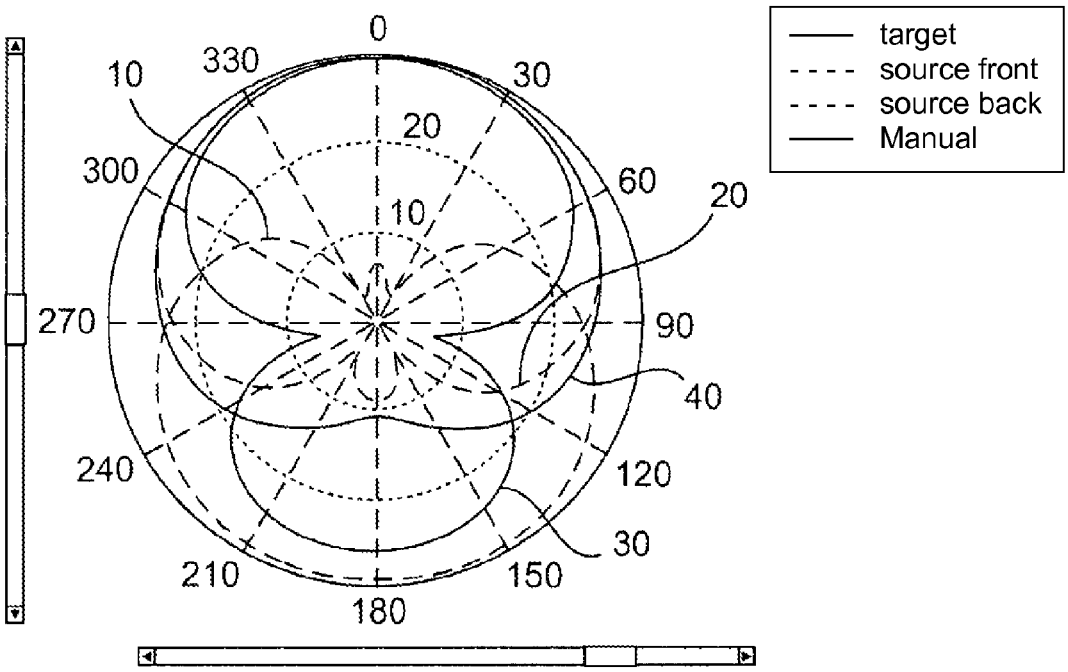
FIGS. 3 and 4 show different polar patterns of a source microphone as well as a polar pattern of a microphone according to the invention.
Figure 4:
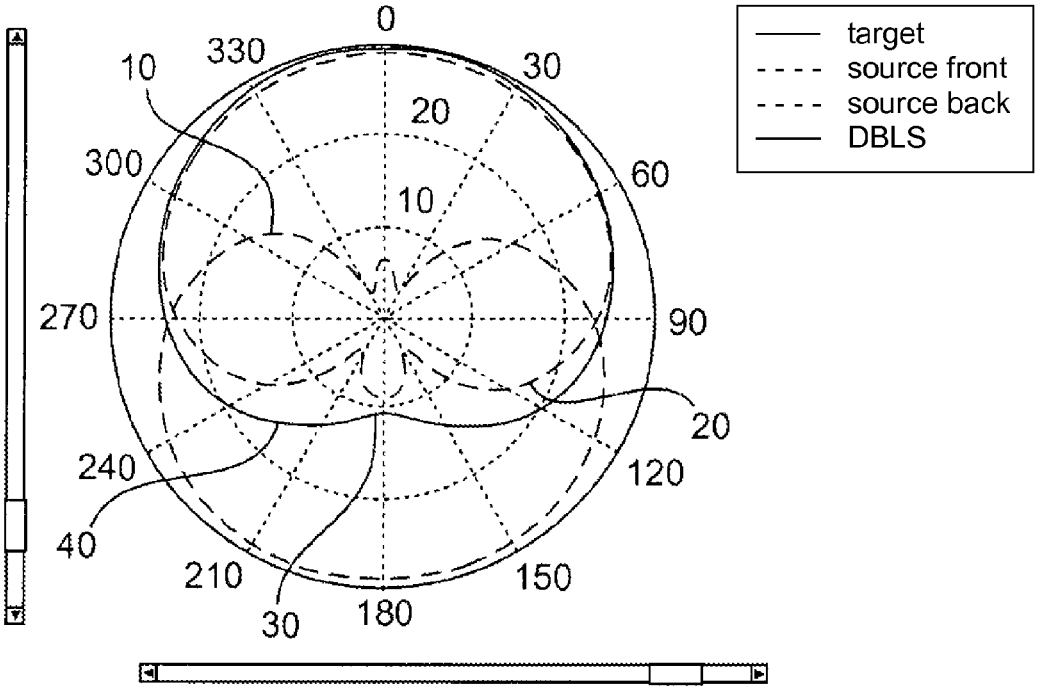

FIGS. 3 and 4 show different polar patterns of a source microphone as well as a polar pattern of a microphone according to the invention. In FIG. 3, the polar patterns of the source microphone for the front capsule 10 and the back capsule 20 is depicted. Furthermore, an unmatched combined signal 30 and the signal from the target microphone 40 is depicted.

In FIG. 4, the polar patterns of the front and back capsule 10, 20 and a polar pattern 30 obtained based on the DBLS algorithm as described in FIG. 2 is depicted. Furthermore, the polar pattern of the target microphone is depicted as 40.

In step S4, it is decided which of the described algorithms is to be used. Preferably, the DBLS algorithm as described above is used.

Furthermore, in step S5, the Filter optimization is performed. The parameters of the filters are optimized, for example, by using critical band smoothing, windowing, truncation, arma modelling and least squares methods.

In the third embodiment, the measurement of the characteristics of the target microphone, the generation of the filters, the linear implementation and the non-linear implementation will be described.

Figure 5:
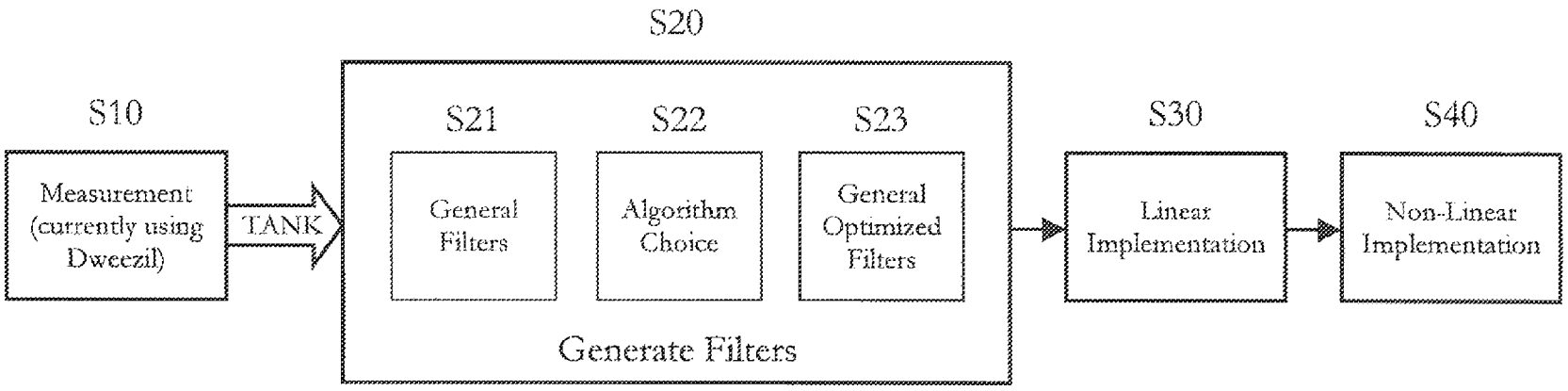
FIG. 5 shows a schematic flow chart of a method for determining characteristics of a target microphone according to a third embodiment.

FIG. 5 shows a schematic flow chart of a method for determining characteristics of a target microphone according to a third embodiment. In step S10, the measurements of the target microphone are performed, in step S20 the filter parameters are generated, in step S30 the linear implementation is provided and in step S40, the non-linear implementation is provided. In step S21, the filters are generated, in step S22, the algorithm is chosen, and in step S23, the optimized filters are generated.

In the following, the measurements according to step S10 are described in more detail. The equipment for measuring the characteristics of a target microphone can include a personal computer, a software running on the computer, for example like Matlab, sound source, optionally a turntable for taking measurements over angle, a reference microphone for equalizing out the response of the speaker (preferably the speaker should have a flat frequency response), a front end microphone and anechoic chamber to simulate a plane wave as well as possible.

During the measurement of the target microphone, the magnitude and the phase of the microphone response over angle is determined and can be stored as a set of impulse responses. Preferably, the measurements are taken using exponential sinusoidal sweeps. This is advantageous to truncate out the non-linearities of the speaker. Optionally, a longer sweep length (at least 131072 samples) is provided in order to increase the SNR.

The angle of the microphone can be changed with at least 5 degree increments. Optionally, one vertical and one horizontal ring can be provided for each microphone. In addition, diagonal measurements can be performed as well. The measurements can be taken at various azimuth and elevation angles.

In order to measure the current filters, the measurements can be performed at a distance of for example two meters. If the distance is increased, the planar characteristics of the incident sound wave can be increased as well. The microphone should be aligned with the acoustic center of the sound source.

Preferably, a reference measurement is performed on the measurement set-up. This is advantageous to normalize the speaker response. Preferably, the position of the reference measurement should correspond to the location of the membrane of the target microphone. The reference measurements should be performed at preferably identical room conditions like temperature etc. Optionally, two reference measurements can be obtained, one before starting and one after finishing the measurements. Optionally, the reference measurements are performed based on a single impulse response. A reference measurement over angle is not required.

During a front end measurement, all capsules should be measured simultaneously. Optionally, different instances of the front end microphone can be measured and an average is determined.

Optionally, a plurality of measurements is performed for each microphone in order to create an average of all measurements. This should be advantageous in view of a robust simulation.

In the following, the generation of the filters is described in more detail. The generation of the filters can be performed in three steps, namely: generation of the filters, choice of the algorithm and filter optimization.

In order to achieve linear filters, data conditioning is performed and a frequency response curve of the various filter algorithms are created over angle.

In step S22, the algorithm is chosen. One option is the rated/constrained least squares method. In order to improve the results, listening tests as well as numerical analysis can be used. The listening test can be performed based on a plurality of different types of content at a plurality of distances on access as well as off access. In addition, the closeness of proximity effect measurements or directivity index measurements can be performed. The quality of the resulting filter parameters can be tested by performing standard microphone measurements.

The ideal filter can be chosen in the frequency domain and then an IFFT (an inverse FFT) can be performed.

For optimizing the filter, smoothing the frequency response/truncation of the FIR filter or the creation of an IR filter for the front end microphone can be performed. The smoothing of the frequency response/truncation of the FIR filter is performed by frequency domain smoothing to reduce the length of the FIR filter. During the creation of an IR filter for the front end microphone, the front channel filter is converted into a minimum phase IIR filter capturing the desired front channel frequency response. A FIR filter is used for the back channel comprising the correct relative phase differences and frequency responses.

In step S23, the optimized filters are generated. The improvement can be performed by using more than the two microphone capsules (front end and back end). To further improve the fitting over frequency and angle, a more powerful non-linear optimization can be used.

According to a third embodiment, the implementation of the linear portion of the microphone simulation can be performed as described in FIG. 1 where the first and second filters are arranged after the two microphone capsules.

In step S40, the non-linear implementation is performed. According to the invention, a saturation curve modelling (simple tube distortion modelling) and a compression modelling (envelop distortion) is performed. Alternatively, in step S40, a linear implementation can be performed.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

What is claimed is:

1. A microphone modeling device for imitating the frequency dependent polar pattern of a target microphone, the microphone modeling device comprising:

at least a first microphone capsule arranged as a front capsule and a second microphone capsule arranged as a back capsule;

at least a first and a second filter, wherein the first filter is coupled to the first microphone capsule and the second filter is coupled to the second microphone capsule; and a summation unit for summing the outputs of the first and the second filter and for outputting a summation signal;

wherein the microphone modeling device provides a microphone modeling device output signal that is based on the summation signal, thereby providing a spatial response of the microphone modeling device, and wherein the first and the second filters perform audio processing based on filter parameters and wherein the filter parameters of the first and second filters are determined beforehand using a method comprising the steps of:

measuring spatial responses of the first and the second microphone capsule by determining sets of impulse responses of the first and the second microphone capsule for different sound incident angles;

measuring a spatial response of the target microphone by determining a set of impulse responses of the target microphone for different sound incident angles, wherein the impulse responses comprise magnitude and phase frequency response information over the sound incident angle for the respective microphone;

matching the spatial response of the microphone modeling device to the spatial response of the target microphone by adjusting the filter parameters of the first and second filters based on a spatial response matching algorithm such that the microphone modeling device with respect to the polar pattern over frequency performs as the target microphone.

2. The microphone modeling device according to claim 1, wherein the spatial response matching algorithm is one of:

a constrained least squares algorithm;

a decibel (dB) based least square algorithm;

a first-order projection algorithm;

a directivity index matching algorithm; and a defuse field matching algorithm.

3. The microphone modeling device according to claim 1 further comprising:

a model unit where the summation signal is undergoing a further processing for obtaining the microphone modeling device output signal; and wherein the further processing is based on a linear or non-linear model.

4. The microphone modeling device according to claim 1, wherein the method for determining the filter parameters further comprises the step of:

performing a signal conditioning on the determined impulse responses;

wherein the signal conditioning comprises at least one of:

a time alignment;

a truncation of the measurement data;

a sinusoidal eccentricity removal;

a smoothing; and a symmetrising by averaging two halves of the polar pattern for each frequency.

* * * * *